US007391154B2

(12) United States Patent
Scholl et al.

(10) Patent No.: US 7,391,154 B2
(45) Date of Patent: Jun. 24, 2008

(54) LOW-PRESSURE GAS DISCHARGE LAMP WITH GAS FILLING CONTAINING TIN

(75) Inventors: Robert Peter Scholl, Roetgen (DE); Rainer Hilbig, Aachen (DE); Achim Gerhard Koerber, Kerkrade (NL); Johannes Baier, Würselen (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 350 days.

(21) Appl. No.: 10/527,113

(22) PCT Filed: Sep. 1, 2003

(86) PCT No.: PCT/IB03/03982

§ 371 (c)(1),
(2), (4) Date: Mar. 8, 2005

(87) PCT Pub. No.: WO2004/025688

PCT Pub. Date: Mar. 25, 2004

(65) Prior Publication Data

US 2005/0242737 A1 Nov. 3, 2005

(30) Foreign Application Priority Data

Sep. 11, 2002 (DE) ..... 102 42 049

(51) Int. Cl.
*H01J 61/12* (2006.01)

(52) U.S. Cl. ..... 313/577; 313/638

(58) Field of Classification Search ..... 313/637–643, 313/568–577

See application file for complete search history.

(56) References Cited

U.S. PATENT DOCUMENTS

| | | | | |
|---|---|---|---|---|
| 2,765,416 | A | 10/1956 | Beese et al. | |
| 3,958,145 | A * | 5/1976 | Jack et al. | 313/642 |
| 4,020,377 | A * | 4/1977 | Popp et al. | 313/112 |
| 4,710,679 | A | 12/1987 | Budinger et al. | |
| 5,723,944 | A * | 3/1998 | Higashi et al. | 313/570 |
| 6,135,840 | A * | 10/2000 | Kanzaki | 313/574 |
| 6,218,781 | B1 * | 4/2001 | Genz et al. | 313/637 |

FOREIGN PATENT DOCUMENTS

| | | |
|---|---|---|
| DE | 24 55 277 A1 | 6/1975 |
| DE | 10044562 A1 | 3/2002 |
| DE | 10044563 A1 | 3/2002 |
| EP | 0407160 A2 | 1/1991 |
| EP | 0407160 A3 | 1/1991 |
| EP | 0407160 B1 | 1/1991 |

* cited by examiner

*Primary Examiner*—Karabi Guharay
*Assistant Examiner*—Christopher M. Raabe

(57) ABSTRACT

A low-pressure gas discharge lamp includes a gas discharge vessel containing an inert gas filling as a buffer gas, and electrodes for generating and maintaining a low-pressure gas discharge. The lamp contains at least one tin halide.

12 Claims, 3 Drawing Sheets

LOW-PRESSURE GAS DISCHARGE LAMP WITH GAS FILLING CONTAINING TIN

The invention relates to a low-pressure gas discharge lamp equipped with a gas-discharge vessel containing a gas filling, with electrodes and with means for generating and maintaining a low-pressure gas discharge.

The generation of light in low-pressure gas discharge lamps is based on the fact that charge carriers, especially electrons but also ions, are accelerated so strongly by an electrical field between the electrodes of the lamp that, in the gas filling of the lamp, owing to collisions with the gas atoms or molecules of the gas filling, they excite or ionize them. When the atoms or molecules of the gas filling return to their normal state, a part of the excitation energy, which may be greater or smaller, is converted into radiation.

Conventional low-pressure gas discharge lamps contain mercury in the gas filling, and are also equipped with a fluorescent coating internally on the gas-discharge vessel. It is a disadvantage of mercury low-pressure gas discharge lamps that mercury vapor emits radiation primarily in the high-energy but invisible UV-C range of the electromagnetic spectrum, which radiation can be converted into visible radiation, with significantly lower energy, only by using these fluorescent materials. The energy difference is hereby converted into undesirable thermal radiation.

The mercury in the gas filling is also increasingly regarded as an environmentally polluting and toxic substance, which should be avoided where possible in modern mass production owing to the environmental hazard involved in its use, production and disposal.

It is already known that the spectrum of low-pressure gas discharge lamps can be influenced by replacing the mercury in the gas filling with other substances. For instance, it is already known from German patent applications DE 100 44 562 and DE 100 44 563 that an indium compound or a copper compound can be used together with a buffer gas as the gas filling in low-pressure gas discharge lamps.

The use of tin halides has hitherto been known only from German patent application DE 24 55 277 for high-pressure discharge lamps with a quantity of inert gas as the starter gas between 0 and 50 mg/cm$^3$ mercury and at least 1 μmol of at least one tin halide, wherein the discharge vessel contains at least one of the elements indium, bismuth, lead, gallium and zinc, either as such or in the form of at least one of their halides in a quantity that is effective for correcting the color point of the radiation emitted by the lamp.

It was the object of the present invention to create an environmentally friendly low-pressure gas discharge lamp, free of mercury vapor, which delivers a high radiation yield in the visible range of the electromagnetic spectrum or invisible UV radiation near to the visible spectrum which, with the aid of fluorescent materials, can be converted into visible radiation with a low energy loss, The discharge lamp thereby has a higher efficiency than low-pressure gas discharge lamps which primarily emit very shortwave UV radiation, which can be converted into visible radiation by fluorescent materials only with a loss of energy. An example of the latter discharges is the fluorescent lamp based on the radiation of atomic mercury.

This object is achieved in accordance with the invention by a low-pressure gas discharge lamp, which is equipped with a gas discharge vessel containing an inert gas filling as the buffer gas, and with electrodes and with means for generating and maintaining a low-pressure gas discharge, and which contains at least one tin halide.

A low-pressure gas discharge lamp of this kind generally contains $2\times10^{-11}$ to $2\times10^{-9}$ mole/cm$^3$ of tin halides in the gas phase. Particularly preferred is a quantity of approximately $2\times10^{-10}$ mole/cm$^3$ of tin halides in the gas phase, corresponding to an operational pressure of approximately 10 μbar.

Figure 1:
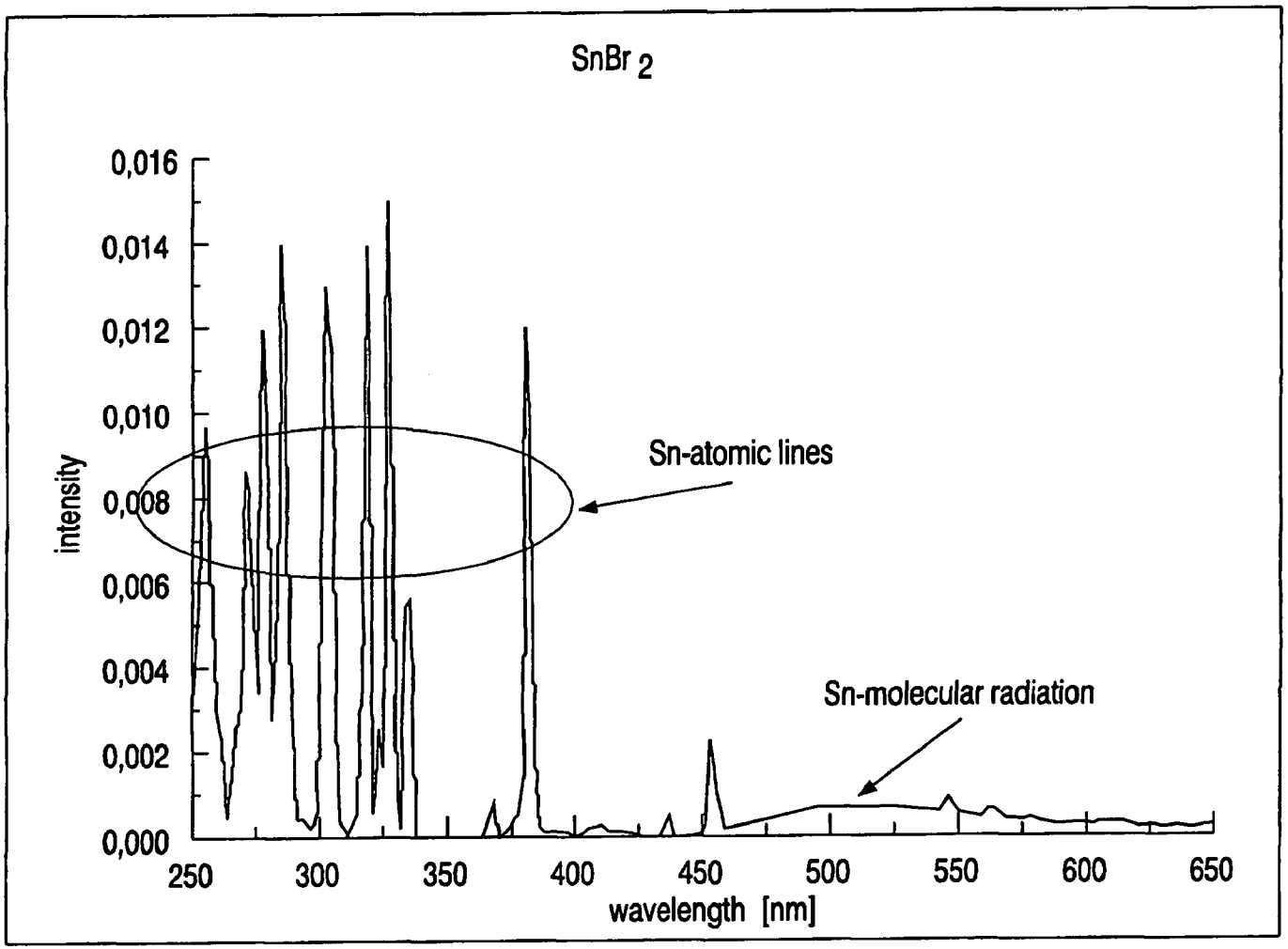
FIGS. 1 and 2 show the spectrum of a discharge according to an embodiment of the invention.

In the lamp in accordance with the invention, a molecular gas discharge takes place at low pressure, emitting radiation in the visible and near UVA range of the electromagnetic spectrum. A spectrum of this kind is shown in FIG. 1 and shows, in the UV range, the spectrum of the Sn atomic lines and, in the visible range, the Sn molecular radiation. Only the UV radiation then has to be converted into visible radiation by means of a suitable fluorescent material. Conversely, the visible portion of the radiation no longer needs to be converted with a fluorescent material, which gives rise to the high efficiency of the lamp in accordance with the invention. Since this is the radiation of a molecular discharge, the precise position of the broad continuum in the range from 450 to 550 nm can be controlled by means of the nature of the tin compounds, any further additives and the internal lamp pressure and operating temperature.

Combined with fluorescent materials, the lamp in accordance with the invention has a visual efficiency that is considerably higher than that from conventional low-pressure mercury discharge lamps. The visual efficiency, expressed in lumen/watt, is the ratio between the brightness of the radiation in a certain visible wavelength range and the generation energy for the radiation. The high visual efficiency of the lamp in accordance with the invention means that a certain quantity of light is realized through lower power consumption.

An especially advantageous operational pressure for the lamp in accordance with the invention is achieved by setting the wall temperature of the discharge vessel to a temperature of T*±50 K. T* is hereby 220° C. for tin chloride, 230° C. for tin bromide and 275° C. for tin iodide. The losses occurring during heating can be minimized by the use of heat-reflecting outer bulbs, such as those realized in, for example, sodium-vapor low-pressure gas discharge lamps.

The gas filling of the lamp in accordance with the invention comprises a tin halide and an inert gas. The inert gas serves as a buffer gas. The preferred buffer gas is argon. Argon may be replaced, either wholly or partially, by another inert gas such as helium, neon, krypton or xenon. The gas pressure of the inert gas at operating temperature advantageously equals 1 to 5 mbar, and is preferably around 2 mbar.

The gas discharge vessel used in accordance with the invention generally has a fluorescent coating on the outer surface. The UVA radiation emitted by the lamp in accordance with the invention is not absorbed by the normal wall materials, and passes the walls of the discharge vessel with virtually no losses. The wall materials preferably used are quartz, aluminum oxide, yttrium aluminum garnet or similar known glass materials. Since these materials allow UVA radiation to pass through virtually unhindered, the fluorescent coating may also be applied to the exterior of the gas discharge vessel. The manufacturing process is thereby simplified. Undesired interactions of the discharge plasma with the fluorescent material (chemical reactions, aging under hard UV radiation, thermal damage) can also be excluded as a result.

Very varied geometries are possible for the discharge vessel. Cylinders and spherical geometries are preferably used.

In the lamp in accordance with the invention, the discharge can be excited capacitively or inductively with external electrodes and a high-frequency alternating field, for example 2.65 MHz, 13.56 MHz, . . . , 2.4 GHz etc. Operation is also possible with internal electrodes made of conductive materials (for example tungsten or rhenium). The internal electrodes may hereby also be provided with an emitter material of low work function.

The lamp in accordance with the invention may be used for general lighting purposes if it is equipped with appropriate fluorescent materials. As the losses from the Stokes Shift are low, visible light is obtained with a high light yield of more than 100 lumen/watt.

EMBODIMENT EXAMPLE

Figure 2:
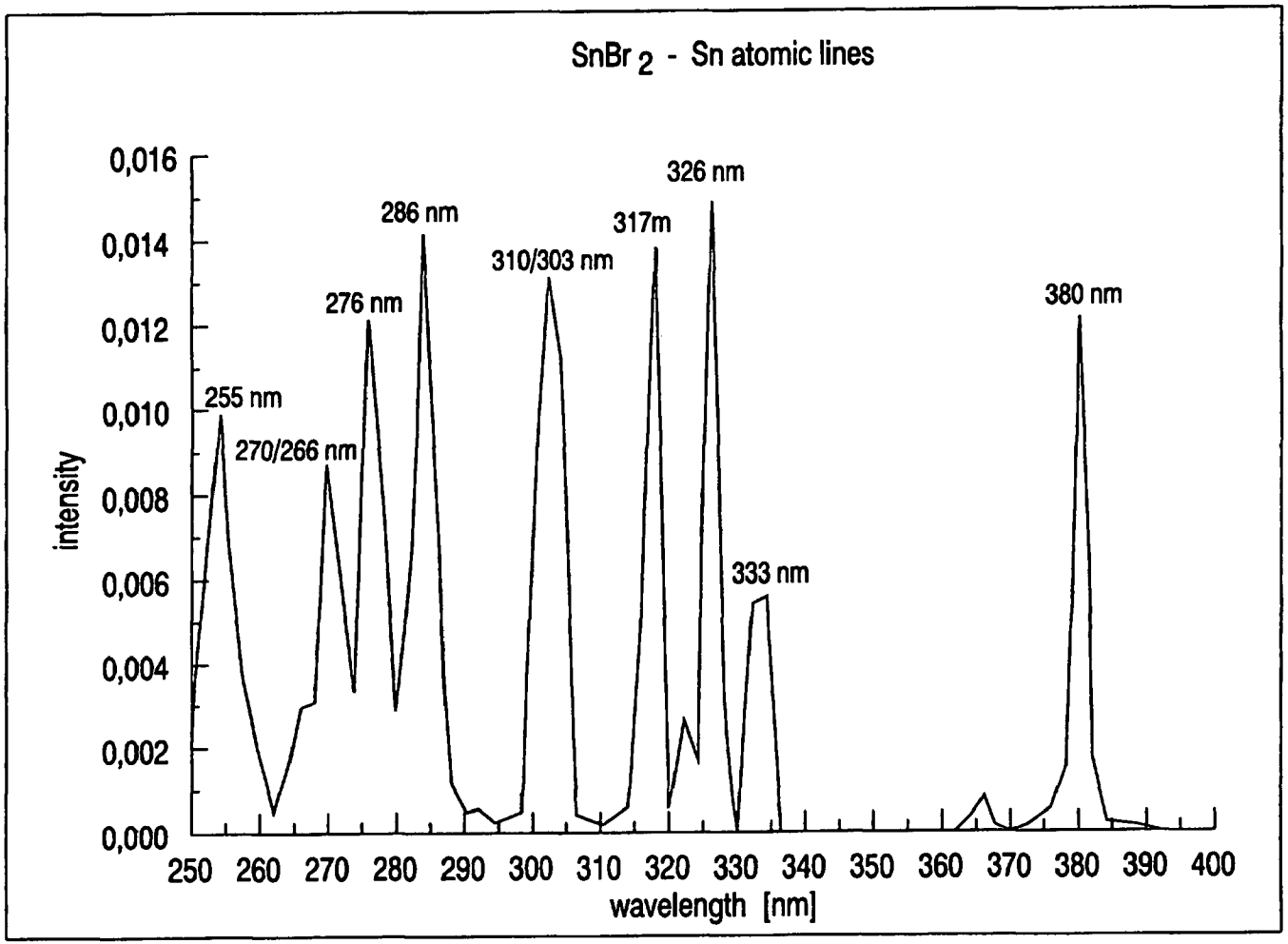
Figure 3:
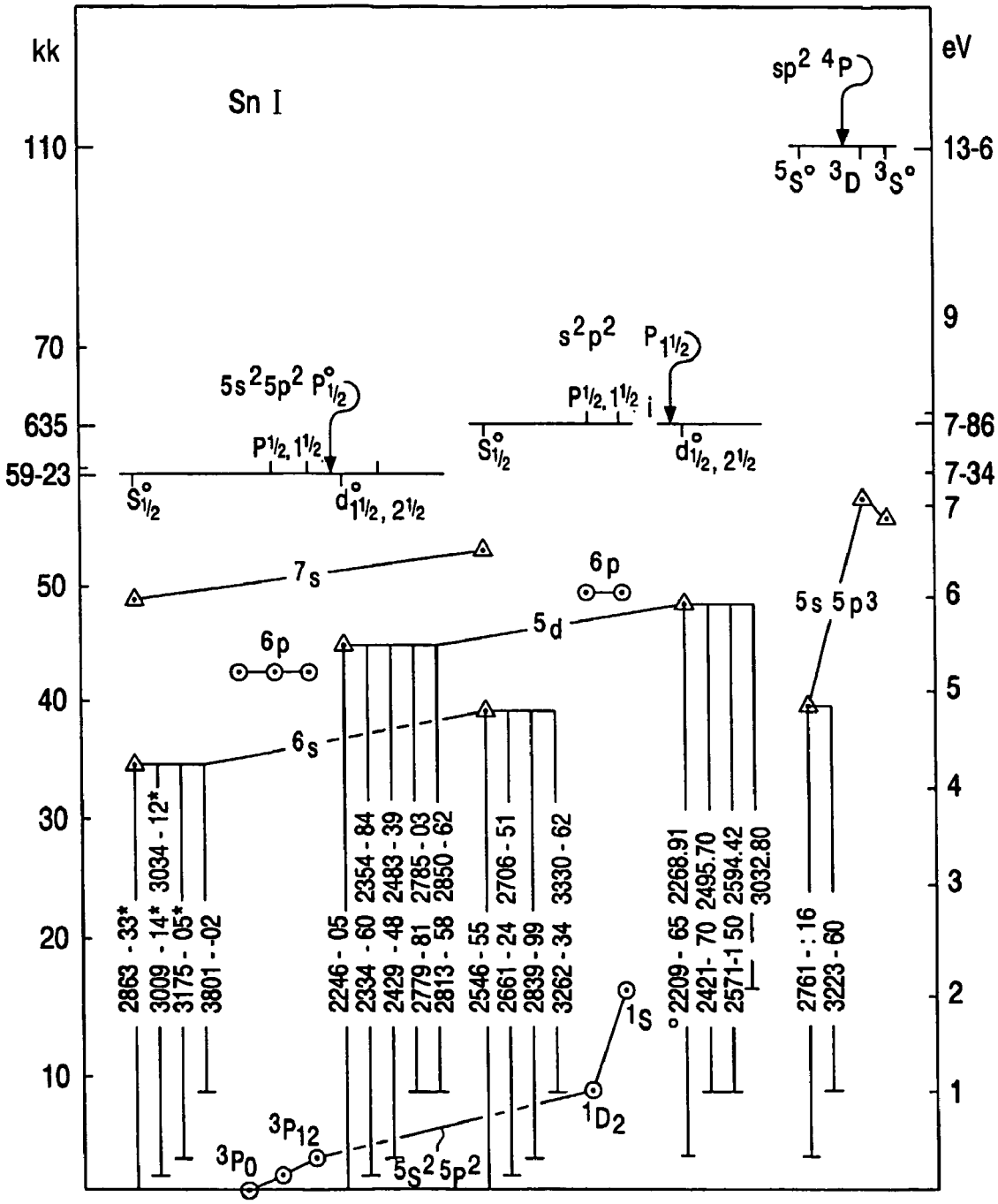
FIG. 3 shows a term scheme of Sn.

FIG. 1 shows the spectrum of a discharge excited with 13.56 MHz and external electrodes. The discharge vessel was cylindrical in shape and was 14 cm long and 2.5 cm in diameter. The filling comprised 0.3 mg $SnBr_2$ and 5 mbar Ar (cold pressure). The discharge power was 3 watts. The wall temperature was set to 220° C. Clearly discernible are the Sn lines (see also FIG. 2 and FIG. 3 with the term scheme of Sn) and the broad continuum in the visible spectral range.

The invention claimed is:

1. A low-pressure gas discharge lamp, comprising:

a gas discharge vessel containing an inert gas filling and $2\times10^{-11}$ to $2\times10^{-9}$ mole/cm$^3$ of tin halides in a gas phase;

electrodes; and means for generating and maintaining a low-pressure gas discharge.

2. The low-pressure gas discharge lamp as claimed in claim 1, wherein a gas pressure of the inert gas lies in between 1 and 5 mbar.

3. The low-pressure gas discharge lamp as claimed in claim 1, wherein a UV radiation emitted as a result of the discharge is converted into visible radiation by means of suitable fluorescent materials.

4. The low-pressure gas discharge lamp as claimed in claim 1, wherein walls of the discharge device comprise quartz, $Al_2O_3$, or yttrium-aluminum garnet.

5. The low-pressure gas discharge lamp as claimed in claim 1, wherein the discharge can be excited inductively or capacitively with external electrodes and a high-frequency alternating field.

6. The low-pressure gas discharge lamp as claimed in claim 1, wherein the electrodes comprise conductive materials.

7. The low-pressure gas discharge lamp as claimed in claim 1, wherein the electrodes are provided with a material of low work function.

8. The low-pressure gas discharge lamp as claimed in claim 1, wherein the electrodes comprise rhenium.

9. The low-pressure gas discharge lamp as claimed in claim 1, wherein the electrodes comprise tungsten.

10. The low-pressure gas discharge lamp as claimed in claim 1, further comprising a fluorescent coating on an outer surface of the gas discharge vessel.

11. A low-pressure gas discharge lamp comprising:

a gas discharge vessel containing an inert gas and approximately $2\times10^{-10}$ mole/cm$^3$ of tin halides in the gas phase, corresponding to an operational pressure of approximately 10 μbar;

electrodes; and means for generating and maintaining a low-pressure gas discharge.

12. A low-pressure gas discharge lamp comprising:

a gas discharge vessel containing an inert gas filling including at least one tin halide which is a chloride, bromide or iodide;

electrodes; and means for generating and maintaining a low-pressure gas discharge, wherein a wall temperature of T*±50 K is set, and wherein T* is 220° C. if the at least one tin halide is tin chloride, 230° C. if the at least one tin halide is tin bromide, and 275° C. if the at least one tin halide is tin iodide.

* * * * *